US008736534B2

(12) United States Patent
Yamamoto et al.

(10) Patent No.: US 8,736,534 B2
(45) Date of Patent: May 27, 2014

(54) ACTIVE MATRIX LIQUID CRYSTAL DISPLAY DEVICE AND METHOD OF DRIVING THE SAME

(75) Inventors: Etsuo Yamamoto, Mie (JP); Yuhichiroh Murakami, Mie (JP); Yasushi Sasaki, Mie (JP); Seijirou Gyouten, Mie (JP)

(73) Assignee: Sharp Kabushiki Kaisha, Osaka (JP)

( * ) Notice: Subject to any disclaimer, the term of this patent is extended or adjusted under 35 U.S.C. 154(b) by 1923 days.

(21) Appl. No.: 11/922,491

(22) PCT Filed: Jul. 11, 2006

(86) PCT No.: PCT/JP2006/313795
§ 371 (c)(1),
(2), (4) Date: Dec. 19, 2007

(87) PCT Pub. No.: WO2007/007768
PCT Pub. Date: Jan. 18, 2007

(65) Prior Publication Data

US 2009/0085902 A1 Apr. 2, 2009

(30) Foreign Application Priority Data

Jul. 14, 2005 (JP) ..... 2005-206105
Dec. 15, 2005 (JP) ..... 2005-362193

(51) Int. Cl.
*G09G 3/36* (2006.01)

(52) U.S. Cl.
USPC ..... 345/98; 345/100

(58) Field of Classification Search
CPC .. G09G 3/3607; G09G 3/3611; G09G 3/3648
USPC ..... 345/76, 87, 100, 211, 690; 713/300; 349/43, 54; 361/56
See application file for complete search history.

(56) References Cited

U.S. PATENT DOCUMENTS

| | | | | |
|---|---|---|---|---|
| 6,137,465 | A * | 10/2000 | Sekine et al. | 345/98 |
| 2004/0104908 | A1 | 6/2004 | Toyozawa et al. | |
| 2004/0196278 | A1 * | 10/2004 | Kida et al. | 345/211 |
| 2005/0024081 | A1 * | 2/2005 | Kuo et al. | 324/770 |
| 2005/0231491 | A1 * | 10/2005 | Yeh | 345/204 |
| 2006/0145951 | A1 * | 7/2006 | Watanabe et al. | 345/55 |

FOREIGN PATENT DOCUMENTS

| | | |
|---|---|---|
| CN | 1487494 | 4/2004 |
| CN | 1547730 | 11/2004 |
| JP | 2000-347627 | 12/2000 |
| JP | 2001-022326 | 1/2001 |
| JP | WO03109210 | * 11/2003 |

(Continued)

*Primary Examiner* — Quan-Zhen Wang
*Assistant Examiner* — Calvin C Ma
(74) *Attorney, Agent, or Firm* — Harnes, Dickey & Pierce, P.L.C.

(57) ABSTRACT

In one embodiment of the present invention, on each source bus line, an electric charge escaping transistor is provided having the same polarity as a pixel transistor and having a gate to which a turn-off voltage signal of the pixel transistor is supplied. When an active matrix liquid crystal display device is powered off, the turn-off voltage signal is made to reach the GND level before a turn-on voltage signal of the pixel transistor reaches the GND level, so that the pixel transistor and the electric charge escaping transistor are made half-open. This lets electric charges accumulated in the pixel escape to a common electrode TCOM.

16 Claims, 13 Drawing Sheets

(56) References Cited

FOREIGN PATENT DOCUMENTS

| | | | | |
|---|---|---|---|---|
| JP | 2004-004244 | 1/2004 | | |
| JP | 2004-045785 | 2/2004 | | |
| JP | 2004-219682 | 8/2004 | | |
| JP | 2004-226597 | 8/2004 | | |
| JP | 2005-308823 | 11/2005 | | |
| NL | WO2004072941 | * 8/2004 | ..... | G09G 3/20 |
| WO | WO 03/102910 | 12/2003 | | |

* cited by examiner

ACTIVE MATRIX LIQUID CRYSTAL DISPLAY DEVICE AND METHOD OF DRIVING THE SAME

TECHNICAL FIELD

The present invention relates to active matrix liquid crystal display devices.

BACKGROUND ART

In liquid crystal display devices, display elements are capacitive elements, a voltage is applied between electrodes which are arranged so as to sandwich the liquid crystal layer therebetween, and image display is performed with pixel-by-pixel control of transmittance of the liquid crystal layer. In an active matrix liquid crystal display device, a pixel electrode is connected to a source bus line via a switching element (pixel transistor), and electric charges of the pixel during a non-selected period are retained when the switching element is turned off.

In such an active matrix liquid crystal display device, electric charges retained in the pixel electrode need to be let out at the power-off of the device. As a matter of course, this operation is performed because displayed image does not disappear on an active matrix liquid crystal display device which has been powered off if the electric charges remain in the pixel electrode.

In the active matrix liquid crystal display device which has been powered off, voltages of all source bus lines and gate bus lines are finally dropped to the GND level, and electric charges retained in each pixel disappear by virtue of a leak current with the passage of time. In other words, displayed image disappears since a leak current combines with electric charges remained in circuits in a panel, pixels, and other components, and voltages of all the components in the panel finally come close to the same voltage. In this case, however, it takes too much time to let out electric charges in the pixels, and defective image caused by the remaining electric charges appears on the display until the display image disappears. Therefore, in the active matrix liquid crystal display device, it is necessary to quickly let out electric charges of the pixel electrodes at the power-off of the device. The following will describe a method of quickly letting out electric charges of the pixel electrodes at the power-off of the device with reference to FIG. 10.

FIG. 10 shows the arrangement of components related to a source bus line 101 in an active matrix liquid crystal display device. As illustrated in FIG. 10, a pixel 103 is connected to the source bus line 101 via a pixel transistor 104. More specifically, a pixel electrode in the pixel 103 is connected to a drain of a pixel transistor 104, and the source bus line 101 is connected to a source of the pixel transistor 104. Furthermore, a gate of the pixel transistor 104 is connected to the gate bus line 102.

To a display-signal-supply end of the source bus line 101 (on the upper side of FIG. 10), a sampling transistor 105 and an end buffer 106 for a signal that controls the sampling transistor 105 are connected. The sampling transistor 105 switches on/off application of a display signal to the source bus line 101. To a scan-signal-supply end (on the left side of FIG. 10) of the gate bus line 102, an end buffer 107 that controls a scan signal supplied to the gate bus line 102 is connected.

A possible approach to letting out electric charges of a pixel electrode at the power-off of the liquid crystal display device arranged in FIG. 10 is to drop a voltage VSS to the GND before a voltage VDD drops thereto. FIG. 11 illustrates the voltages VSS and VDD until the voltages VSS and VDD drop to the GND.

At this time, when the VSS voltage reaches the GND before the voltage VDD reaches the GND, LOW level of a scan signal increases, and the pixel transistor 104 to which a scan signal of the voltage VSS is fed becomes half-open (the pixel transistor is not completely turned on, but has a certain degree of electrical continuity). This makes it possible to let the electric charges accumulated in the pixel 103 escape to the source bus line via the pixel transistor 104. Further, in a case where the pixel transistor 104 and the sampling transistor 105 have the same polarity (In FIG. 10, both the pixel transistor 104 and the sampling transistor 105 are N-channel transistors), the sampling transistor 105 also becomes half-open when a voltage VSS is set to GND. This lets the electric charges escaping to the source bus line escape to the outside through the sampling transistor 105.

Patent documents 1 and 2 disclose another methods for letting out electric charges of pixels at the power-off of the active matrix liquid crystal display device.

That is, Patent Document 1 discloses a method in which each source bus line is connected to a common signal power source via a CMOS-type FET, and at the power-off of a liquid crystal display device, active elements (pixel transistors) of all pixels are brought into electrical continuity, and the CMOS-type FET is brought into electrical continuity to supply a common signal voltage to each source bus line, so that a potential difference between the pixels is eliminated.

Patent Document 2 discloses a method in which at the power-off of the liquid crystal display device, active elements (pixel transistors) of all pixels are brought into electrical continuity, and a voltage that is at the same potential as a common signal voltage is supplied from the source driver to each source bus line.

[Patent Document 1]

Japanese Unexamined Patent Publication No. 347627/2000 (Tokukai 2000-347627; published on Dec. 15, 2000)

[Patent Document 2]

Japanese Unexamined Patent Publication No. 45785/2004 (Tokukai 2004-45785; published on Feb. 12, 2004)

DISCLOSURE OF THE INVENTION

However, the conventional arrangement described with reference to FIG. 10 has the following problem. That is, although electric charges of the pixel electrode can be let out if the pixel transistor and the sampling transistor have the same polarity, electric charges of the pixel electrode cannot be let out if these transistors have different polarities. The following will describe the above problem.

FIG. 12 shows the arrangement in which a pixel transistor 114 and a sampling transistor 115 are transistors with different polarities. Specifically, in the arrangement of FIG. 12, the pixel transistor 104 is N-channel transistor, whereas the sampling transistor 115 is a P-channel transistor.

As in the arrangement of FIG. 10, a period in which the pixel transistor 114 becomes half-open can be obtained by dropping the voltage VSS to the GND before the voltage VDD reaches the GND in the arrangement of FIG. 12. However, since the sampling transistor 115 is not electrically continuous at the same time when the pixel transistor 114 is half-open, electric charges having been let out from the pixel 103 cannot escape through the source bus line 101. In the arrangement of FIG. 12, the sampling transistor 115 is a P-channel transistor. When the voltage VSS rise to the GND level, turn-on signal level of a control signal for the sampling transistor 115 increases. As a result of this, the sampling transistor 115 is less likely to be electrically continuous. Therefore, at the power-off, electric charges having been let out from the pixel 103 cannot be let out from the source bus line 101, and a voltage is applied to the liquid crystal layer of the pixel 103. This causes a defective image.

As illustrated in FIG. 13, in a case where a pixel transistor 124 is a P-channel transistor and the sampling transistor 125 is an N-channel transistor, the same problem occurs. In this case, the pixel transistor 124 becomes half-open when the VDDG voltage is dropped to the GND level before the voltage VSS reaches the GND level, as illustrated in FIG. 14. At this time, a turn-on signal level of a control signal for the sampling transistor 125 decreases. As a result of this, the sampling transistor 125 is less likely to be electrically continuous.

In FIGS. 15 and 16, sampling transistors are an N-channel sampling transistor 135A and a P-channel sampling transistor 135B. To a gate of the sampling transistor 135A, an end buffer 136A is connected. To a gate of the sampling transistor 135B, an end buffer 136B is connected. In FIG. 15, an N-channel pixel transistor 104 is provided. In FIG. 16, a P-channel pixel transistor 124 is provided.

In the arrangement of FIG. 15, the pixel transistor 104 is an N-channel transistor. Therefore, pixel transistor 104 becomes half-open when the voltage GVSS that gives a Low level to the pixel transistor 104 is increased to the GND level before the voltage VDD reaches to the GND level. Further, in the arrangement of FIG. 15, the sampling transistor 135A is a transistor whose polarity is the same (N-channel) as that of the pixel transistor 104. However, unlike the GVSS, the voltage VSS that gives a Low level to the pixel transistor 135A cannot be increased to the GND level. Therefore, as illustrated in FIG. 17, there exists a period in which electric charges of the pixel cannot be let out from the N-channel sampling transistor 135A. In other words, there exists a period in which electric charges having been let out from the pixel to the source bus line cannot let out through the sampling transistor.

Similarly, in the arrangement of FIG. 16, there exists a period in which electric charges of the pixel cannot be let out from the P-channel sampling transistor 135B (see FIG. 18). This is because even when the voltage VDDG that gives High level to the pixel transistor 104 is dropped to the GND level before the voltage VSS reaches the GND level, the voltage VDD that give High level to the sampling transistor 135B does not decrease to the GND level, unlike the voltage VDDG. That is, in this case, there also exists a period in which electric charges having been let out from the pixel to the source bus line cannot let out through the sampling transistor.

In the foregoing active matrix liquid crystal display device, (a) the polarities of the pixel transistor and the sampling transistor and (b) the conditions concerning power supply voltages of signals for on/off control of these transistors cannot be determined in consideration of only the circumstances where electric charges of the pixel need to be let out. This is because the elements (a) and (b) have influence on power consumption and other properties of the liquid crystal display device and are thus determined in consideration of various elements. Therefore, in many cases, normal active matrix liquid crystal display devices cannot have the setting as illustrated in FIG. 10, i.e. the setting which enables electric charges to be let out at the power-off.

In the arrangements disclosed in Patent Documents 1 and 2, the liquid crystal display device can let out electric charges of the pixel at the power-off, regardless of polarity of the pixel transistor and the sampling transistor. However, these arrangements require a control signal or the like for special operation. This results in complexity and upsizing of the device.

The present invention has been attained to solve the above problems and an object of the present invention is to realize a liquid crystal display device with a simple configuration, wherein when the liquid crystal display device is powered off, electric charges of pixels are let out without the need for a control signal for letting out the electric charges of the pixels.

In order to solve the above problems, an active matrix liquid crystal display device according to the present invention includes: a plurality of source bus lines; a plurality of gate bus lines; and pixels each provided at an intersection of the source bus line and the gate bus line and each connected to the gate bus line and the source bus line via a pixel transistor, and the active matrix liquid crystal display device further includes: an electric charge escaping transistor, provided on each of the source bus lines, having the same polarity as the pixel transistor and having a gate to which a turn-off voltage signal of the pixel transistor is supplied.

According to the above arrangement, the electric charge escaping transistor having the same polarity as the pixel transistor and having a gate to which a turn-off voltage signal of the pixel transistor is supplied is provided on each of the source lines. Even when the electric charges having let out from the pixel to the source bus line cannot let out through the sampling transistor, the above arrangement makes it possible to let the electric charges escape through the electric charge escaping transistor.

Besides, no special control signal is needed to make the pixel transistor and the electric charge escaping transistor half-open. Thus, it is possible to let out electric charges of the pixel with a simple configuration of the device.

Further, another active matrix liquid crystal display device according to the present invention includes: a plurality of source bus lines; a plurality of gate bus lines; and pixels each provided at an intersection of the source bus line and the gate bus line and each connected to the gate bus line and the source bus line via a pixel transistor, and the active matrix liquid crystal display device further includes: an electric charge escaping transistor, provided on each of the source bus lines, having the same polarity as the pixel transistor; and voltage control means generating a gate control voltage from the turn-on voltage signal and the turn-off voltage signal of the pixel transistor and supplying the generated gate control voltage to the gate of the electric charge escaping transistor, wherein the gate control voltage generated by the voltage control means is a voltage for turning off the electric charge escaping transistor during an operation of the active matrix liquid crystal display device, and when the active matrix liquid crystal display device is powered off, the turn-off voltage signal of the pixel transistor is caused to reach a GND-level voltage before a turn-on voltage signal of the pixel transistor reaches the GND-level voltage, so that the gate control voltage changes to a voltage for turning on the electric charge escaping transistor.

According to the above arrangement, the electric charge escaping transistor having the same polarity as the pixel transistor is provided on each of the source lines. The gate control voltage generated by the voltage control means is supplied to the gate of the electric charge escaping transistor. Then, when the active matrix liquid crystal display device is powered off, the turn-off voltage signal of the pixel transistor is caused to reach the GND-level voltage before the turn-on voltage signal of the pixel transistor reaches the GND-level voltage.

When the turn-off voltage signal of the pixel transistor is caused to reach the GND-level voltage, the pixel transistor becomes half-open. In the electric charge escaping transistor, the gate control voltage changes to a voltage for turning on the electric charge escaping transistor. This allows the electric charges accumulated in each of the pixels to be escaped to the outside via the pixel transistor and the electric charge escaping transistor. Thus, it is possible to let out electric charges of the pixel at the power-off of the device. Especially, since the electric charge escaping transistor is not half-open but completely turned on, it is possible to reliably let electric charges escape from the source bus line.

Besides, no special control signal is needed to make the pixel transistor half-open and make the electric charge escaping transistor turn on. Thus, it is possible to let out electric charges of the pixel with a simple configuration of the device.

BEST MODE FOR CARRYING OUT THE INVENTION

Figure 1:
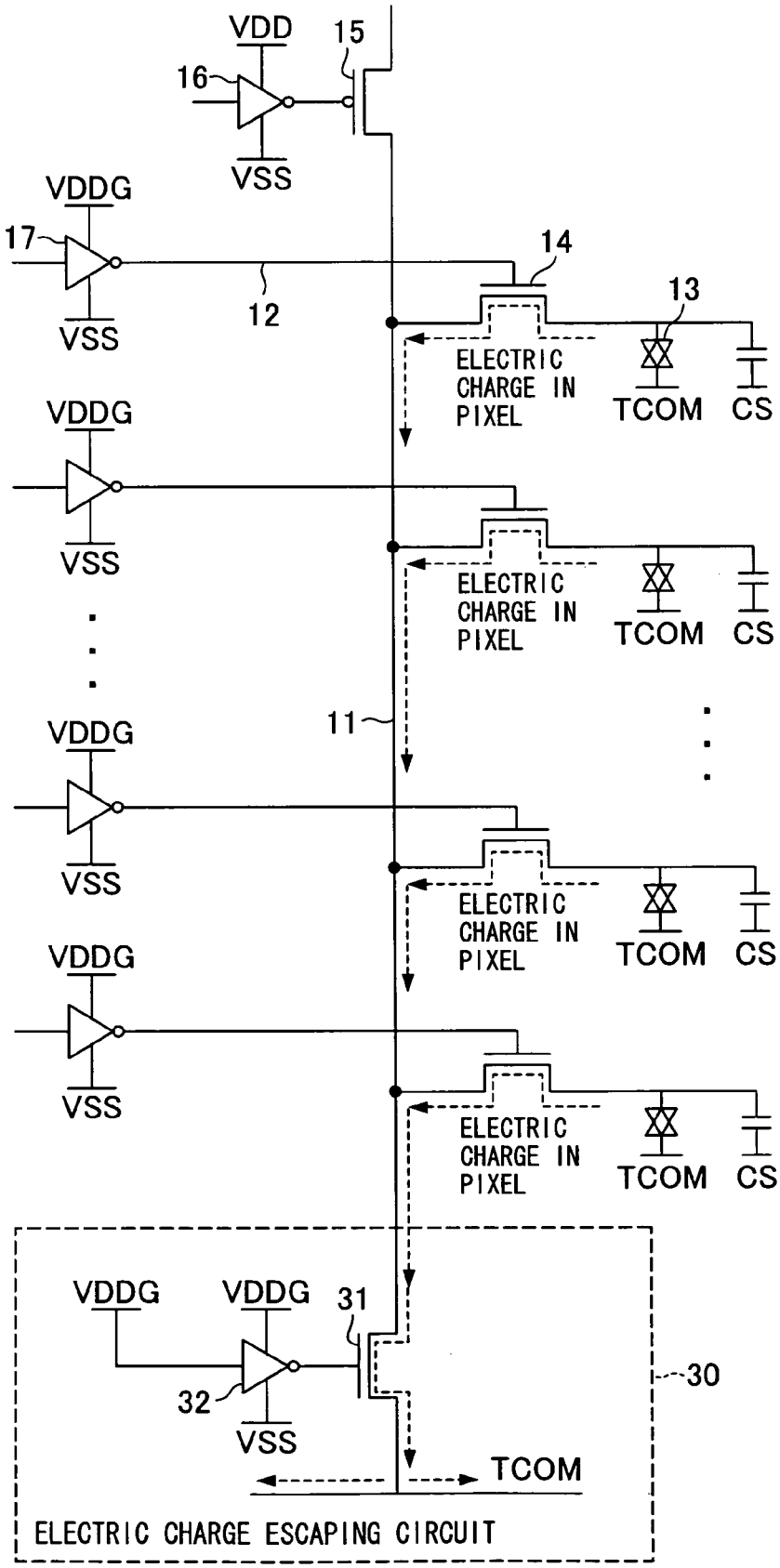
FIG. 1 is a circuit diagram illustrating the configuration of the essential part of an active matrix liquid crystal display device in accordance with an embodiment of the present invention.

The following will describe an embodiment of the present invention with reference to FIGS. 1 through 9 and FIGS. 19 through 24. FIG. 1 illustrates the arrangement of components related to a source bus line 11 in an active matrix liquid crystal display device according to the present embodiment.

As illustrated in FIG. 1, a pixel 13 is connected to a source bus line 11 via a pixel transistor 14. A pixel electrode in the pixel 13 is connected to a drain of the pixel transistor 14, and the source bus line 11 is connected to a source of the pixel transistor 14. Furthermore, a gate of the pixel transistor 14 is connected to the gate bus line 12.

To a display-signal-supply end of the source bus line 11 (on the upper side of FIG. 1), a sampling transistor 15 that switches on/off application of a display signal to the source bus line 11 is connected. To a gate of the sampling transistor 15, an end buffer 16 for a signal that controls the sampling transistor 15 is connected. To a scan-signal-supply end (on the left side of FIG. 1) of the gate bus line 12, an end buffer 17 that controls a scan signal supplied to the gate bus line 12 is connected.

More specifically, the end buffer 16 controls on/off of the sampling transistor 15 by applying either power supply voltage VDD or power supply voltage VSS to the gate of the sampling transistor 15. Since the sampling transistor 15 is a P-channel transistor in the arrangement illustrated in FIG. 1, the sampling transistor 15 is turned on when the voltage VSS is applied thereto, and the sampling transistor 15 is turned off when the voltage VDD is applied thereto.

Meanwhile, the end buffer 17 controls on/off of the pixel transistor 14 by applying either power supply voltage VDDG or power supply voltage VSS to the gate of the pixel transistor 14 via the gate bus line 12. Since the pixel transistor 14 is an N-channel transistor in the arrangement illustrated in FIG. 1, the pixel transistor 14 is turned off when the voltage VSS is applied thereto, and the pixel transistor 14 is turned on when the voltage VDDG is applied thereto.

Furthermore, a liquid crystal display device of the present embodiment includes an electric charge escaping circuit 30 for each of the source bus lines 11. The electric charge escaping circuit 30 includes an electric charge escaping transistor 31 and a buffer 32 that controls a gate signal to be supplied to the electric charge escaping transistor 31. The electric charge escaping transistor 31 is a transistor (N-channel transistor in this case) having the same polarity as the pixel transistor 14, and a source-drain path is provided between the source bus line 11 and a common electrode TCOM.

As with the end buffer 17 connected to the gate bus line 12, the buffer 32 is arranged capable of applying either power supply voltage VDDG or power supply voltage VSS to the gate of the electric charge escaping transistor 31. The actual buffer 32, however, always outputs the voltage VSS to the gate of the electric charge escaping transistor 31. In other words, continuous application of the voltage VSS to the gate of the electric charge escaping transistor 31 provided in the electric charge escaping circuit 30 makes the electric charge escaping transistor 31 turned off all the time during operation of the liquid crystal display device.

Figure 2:
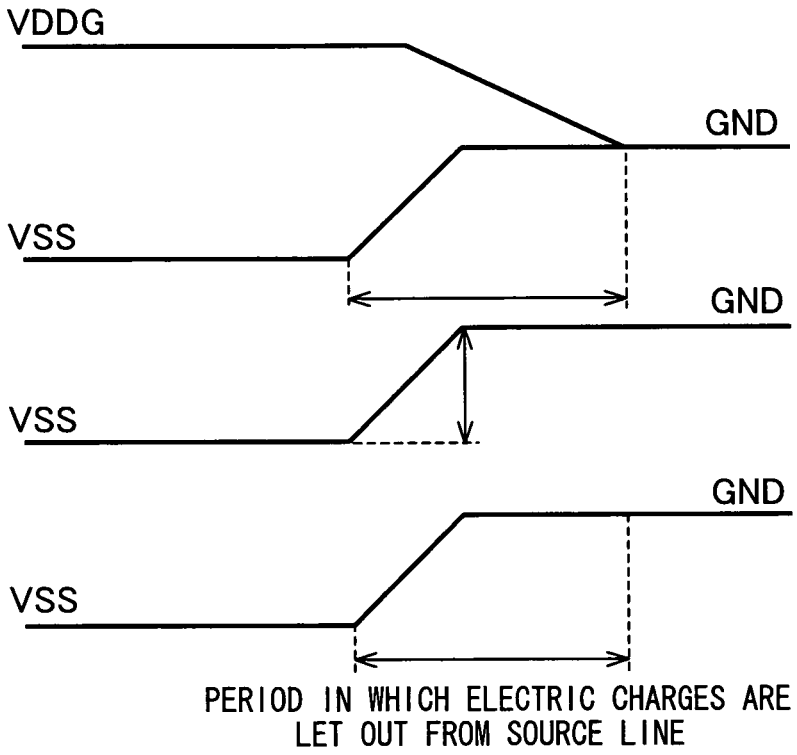
FIG. 2 is a waveform chart illustrating a profile of power supply voltages at the power-off of the active matrix liquid crystal display device.

In the liquid crystal display device arranged as in FIG. 1, when the liquid crystal display device is powered off, the voltage VSS is increased to a GND level before the voltage VDDG reaches the GND level, as illustrated in FIG. 2. With this arrangement, the pixel transistor 14 to which the voltage VSS has been supplied by the end buffer 17 during the power-on of the device becomes half-open at the power-off of the device. This makes it possible to let electric charges retained in the pixel 13 escape to the source bus line 11.

Meanwhile, the sampling transistor 15, which is a P-channel transistor, cannot let electric charges escape from the source bus line 11 even when the voltage VSS reaches the GND level. However, the electric charge escaping transistor 31 provided in the electric charge escaping circuit 30 becomes half-open when the voltage VSS is increased to the GND level. This is because the electric charge escaping transistor 31 is a N-channel transistor, as with the pixel transistor 14, and the voltage VSS is applied to the gate of the electric charge escaping transistor 31.

With this arrangement, in the liquid crystal display device arranged as in FIG. 1, during the period in which the pixel transistor 14 is half-open, the electric charge escaping transistor 31 is also half-opened. Therefore, the electric charges accumulated in the pixel 13 are escaped to the common electrode TCOM via the pixel transistor 14, the source bus line 11, and the electric charge escaping transistor 31. Thus, it is possible to let out electric charges in the pixel 13 when the device is powered off.

Figure 3:
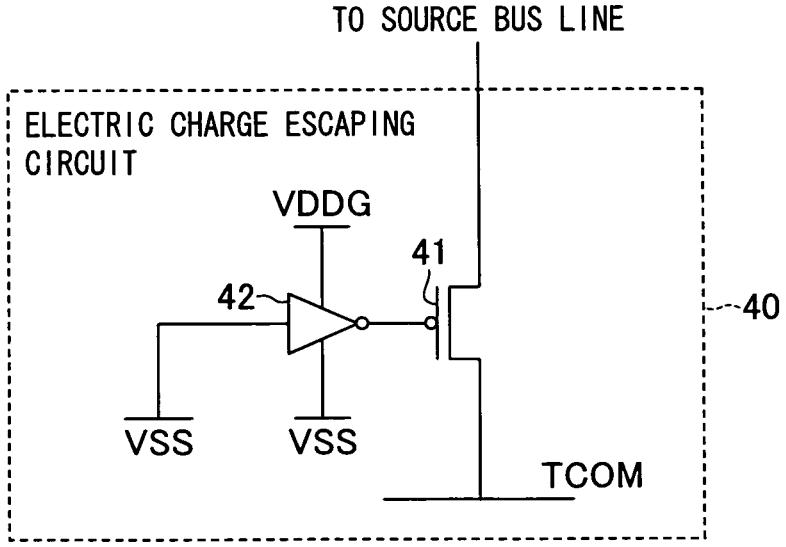
FIG. 3 is a circuit diagram illustrating a configuration of an electric charge escaping circuit included in the active matrix liquid crystal display device.
Figure 4:
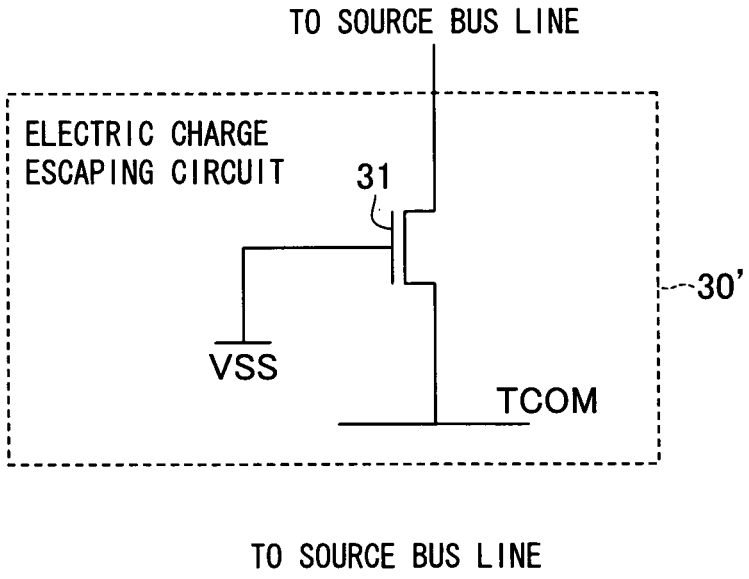
FIG. 4 is a circuit diagram illustrating a configuration of an electric charge escaping circuit included in the active matrix liquid crystal display device.
Figure 5:
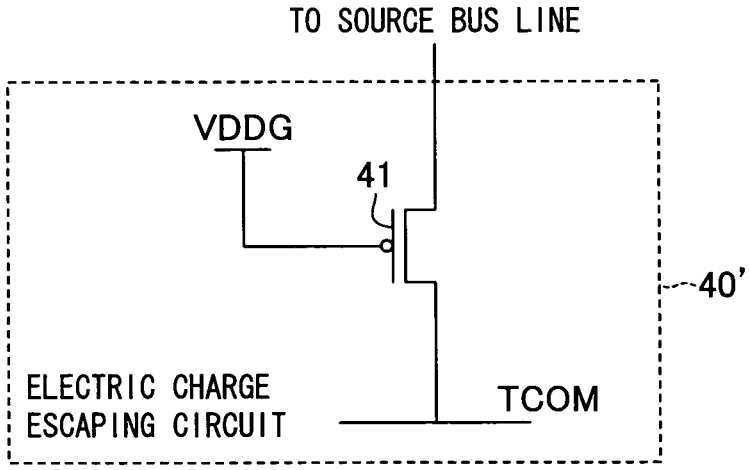
FIG. 5 is a circuit diagram illustrating a configuration of an electric charge escaping circuit included in the active matrix liquid crystal display device.

The electric charge escaping circuit 30 illustrated in FIG. 1 is arranged for the case where the pixel transistor 14 is an N-channel transistor. In a case where the pixel transistor is a P-channel transistor, an electric charge escaping circuit 40 is used as illustrated in FIG. 3. More specifically, the electric charge escaping circuit 40 includes a P-channel electric charge escaping transistor 41 (having the same polarity as a pixel transistor), and a buffer 42 which controls a gate signal supplied to the electric charge escaping transistor 41.

As with the end buffer connected to the gate bus lines, the buffer 42 is arranged capable of applying either power supply voltage VDDG or power supply voltage VSS to the gate of the electric charge escaping transistor 41. However, the actual buffer 42, however, always outputs the voltage VDDG to the gate of the electric charge escaping transistor 41, and the electric charge escaping transistor 41 is therefore turned off all the time during operation of the liquid crystal display device.

Furthermore, in the electric charge escaping circuit 30 illustrated in FIG. 1, the voltage VSS is applied to the gate of the electric charge escaping transistor 31 via the buffer 32. For a simpler arrangement, an electric charge escaping circuit 30' illustrated in FIG. 4 can be adopted in which the buffer 32 is removed so that the voltage VSS is directly applied to the gate of the electric charge escaping transistor 31. Similarly, an electric charge escaping circuit 40' illustrated in FIG. 5 can be adopted in which the buffer 42 is removed so that the voltage VDDG is directly applied to the gate of the electric charge escaping transistor 41.

The arrangements of the electric charge escaping circuit 30 and 40 have the following advantage: That is, in a case where the voltages VSS and VDDG cannot be controlled due to control system trouble or the like, outputs of the buffer 32 and 42 become close to a midpoint voltage between the voltages VSS and VDDG (normally close to the GND voltage). This makes the electric charge escaping transistors 31 and 41 half-open, thus escaping electric charges on the source bus line.

Figure 6:
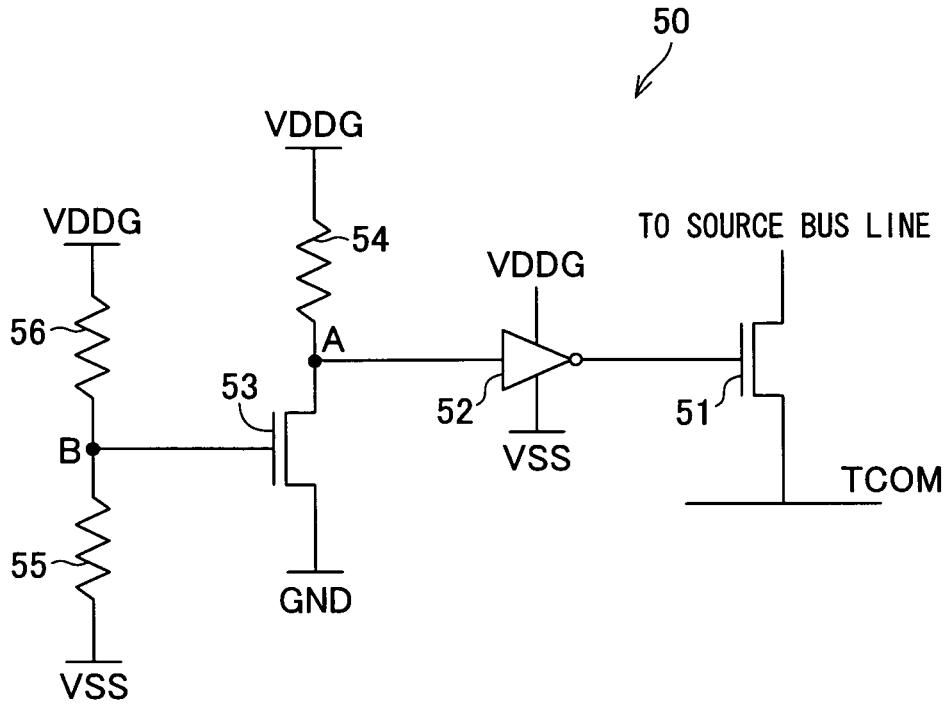
FIG. 6 is a circuit diagram illustrating a configuration of an electric charge escaping circuit included in the active matrix liquid crystal display device.

In the liquid crystal display device according to the present embodiment, an electric charge escaping circuit 50 illustrated in FIG. 6 can be adopted as a variation of an electric charge escaping circuit. The electric charge escaping circuit 50 is an exemplary circuit used in the case where the pixel transistor is a N-channel transistor.

The electric charge escaping circuit 50, as illustrated in FIG. 6, includes an electric charge escaping transistor 51, a buffer 52, a voltage control transistor 53, and resistors 54 through 56. The electric charge escaping transistor 51 is a transistor (N-channel transistor herein) having the same polarity as the pixel transistor, and a source-drain path is provided between a source bus line and a common electrode TCOM.

Further, the buffer 52 is arranged capable of applying either power supply voltage VDDG or power supply voltage VSS to the gate of the electric charge escaping transistor 51 in accordance with an input supplied to a control terminal of the buffer 52. To the control terminal of the buffer 52 is applied a voltage of a node between a drain of the voltage control transistor 53 and one end of the resistor 54. A source of the voltage control transistor 53 is connected to a GND voltage, and the other end of the resistor 54 is connected to the voltage VDDG. To the gate of the voltage control transistor 53 is applied a voltage of a node between one end of the resistor 55 and one end of the resistor 56. The other end of the resistor 55 is connected to the voltage VSS, and the other end of the resistor 56 is connected to the voltage VDDG.

In the electric charge escaping circuit 50 arranged as above, a voltage which is obtained by division of a VSS-to-VDDG voltage by the resistors 55 and 56 is applied to the gate of the voltage control transistor 53. Resistance values of the resistors 55 and 56 are set so that a voltage for turning off the voltage control transistor 53 is applied to the voltage control transistor 53 during operation of the device. When the voltage control transistor 53 is turned off, the voltage VDDG is applied to the control terminal of the buffer 52. Then, the voltage VSS is applied to the gate of the electric charge escaping transistor 51, which turns off the electric charge escaping transistor 51.

On the other hand, when the device is powered off, the voltage VSS drops to the GND level before the voltage VDDG reaches the GND level. Then, a gate voltage of the voltage control transistor 53 increases, which turns on the voltage control transistor 53. When the voltage control transistor 53 is turned on in the situation where resistance of the resistor 54 is sufficiently high, the voltage VSS is applied to the control terminal of the buffer 52. This applies the voltage VDDG to the gate of the electric charge escaping transistor 51, which turns on the electric charge escaping transistor 51.

That is, in the case of the electric charge escaping circuit 50, the electric charge escaping transistor 51 is completely turned on when the device is powered off, instead of being half-open. This makes it possible to more reliably let out electric charges in the source bus line. The circuit illustrated in FIG. 6 is arranged for the case where the pixel transistor is an N-channel transistor. However, even if the pixel transistor is a P-channel transistor, it is possible to completely turn on the electric charge escaping transistor at the power-off of the device on the same principle.

The above-described liquid crystal display device is arranged such that in the case where the pixel transistor is an N-channel transistor, the voltage VSS reaches the GND level before the voltage VDDG does at the power-off of the device, thereby enabling pixel charges to be let out. Additionally, the liquid crystal display device is arranged such that in the case where the pixel transistor is a P-channel transistor, the voltage VDDG reaches the GND level before the voltage VSS does, thereby enabling pixel charges to be let out.

Making the voltage VSS reach the GND level before the voltage VDDG reach the GND level (and vice versa) can be easily realized by performing timing control by means of software at the power-off of the device. The timing control is performed by a power supply control section, which is normally provided in the liquid crystal display device.

The above-described timing control in the power supply control section, however, may not respond to an unexpected power-off of the device (e.g. accidental removal of a device battery by the user). For example, making the voltage VSS reach the GND level before the voltage VDDG (and vice versa) at an unexpected power-off of the device can be realized by employing a power supply control section as illustrated in FIG. 7.

Figure 7:
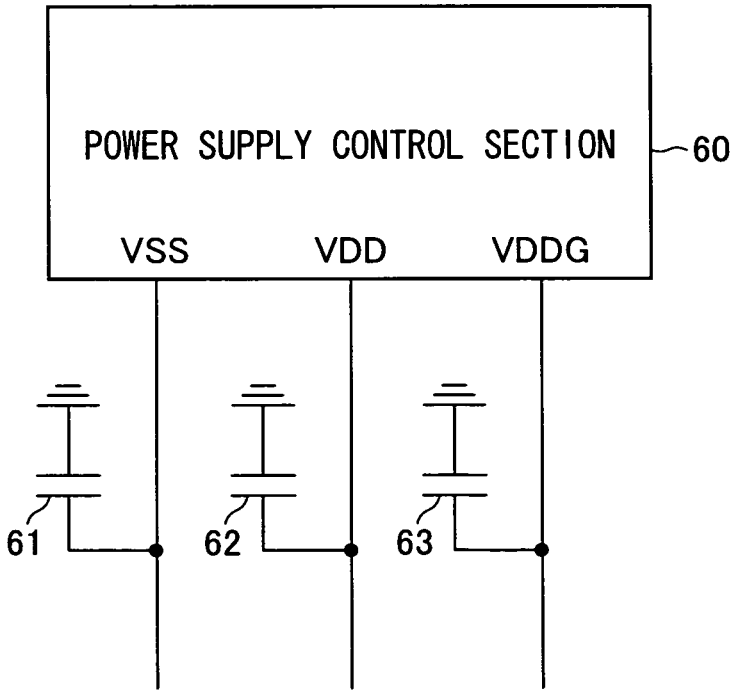
FIG. 7 is a diagram illustrating a configuration of a power supply control section included in the active matrix liquid crystal display device.

FIG. 7 illustrates a power supply control section 60 and three power supply voltages VSS, VDD, and VDDG that the power supply control section 60 outputs. The power supply voltages VSS, VDD, and VDDG outputted from the power supply control section 60 are connected to capacitors 61, 62, and 63, respectively, so that the supplied voltages gradually decrease at an unexpected power-off. For example, assume that capacitance of the capacitor 61 connected to the power supply voltage VSS is set lower than capacitances of the capacitors 62 and 63. In this case, it is possible to make the voltage VSS reach the GND level before the voltage VDDG does. This effect can be also obtained at an unexpected power-off of the device.

The above-described liquid crystal display device assumes that the electric charge escaping circuit escapes electric charges from the source bus line to the common electrode TCOM. However, the present invention is not limited to this. The electric charges may be escaped to places other than the common electrode TCOM if they have a sufficient capacity to store the electric charges escaped from the source bus line.

The above description takes, as an example, the arrangement illustrated in FIG. 2, i.e. the arrangement in which the voltage VSS reaches the GND level before the voltage VDDG (in the case where the pixel transistor and the electric charge escaping transistor are N-channel transistors). The arrangement illustrated in FIG. 2 is easy to realize. However, in the present invention, the voltage VSS may converge on the GND level after the voltage VDDG does as long as there exists the period in which electric charges are let out from the source bus line via the electric charge escaping transistor.

Figure 8:
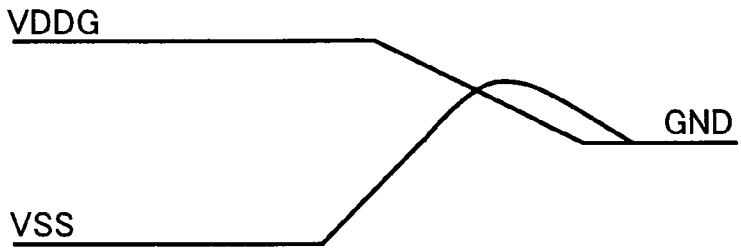
FIG. 8 is a waveform chart illustrating a profile of power supply voltages at the power-off of the active matrix liquid crystal display device.
Figure 9:
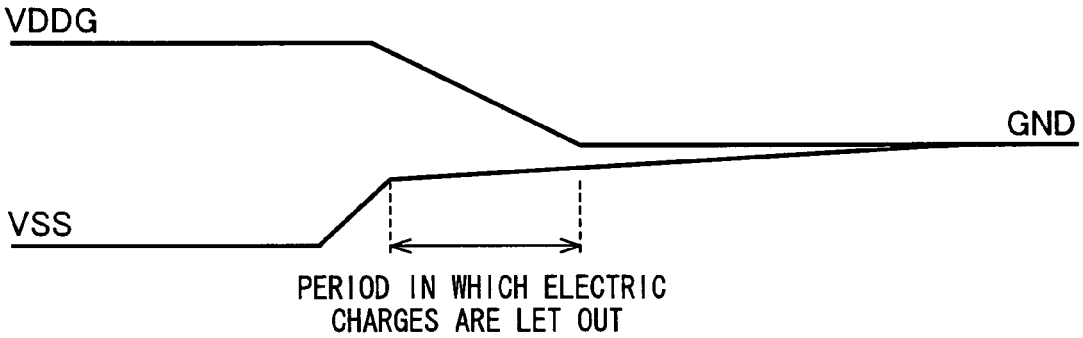
FIG. 9 is a waveform chart illustrating a profile of power supply voltages at the power-off of the active matrix liquid crystal display device.
Figure 10:
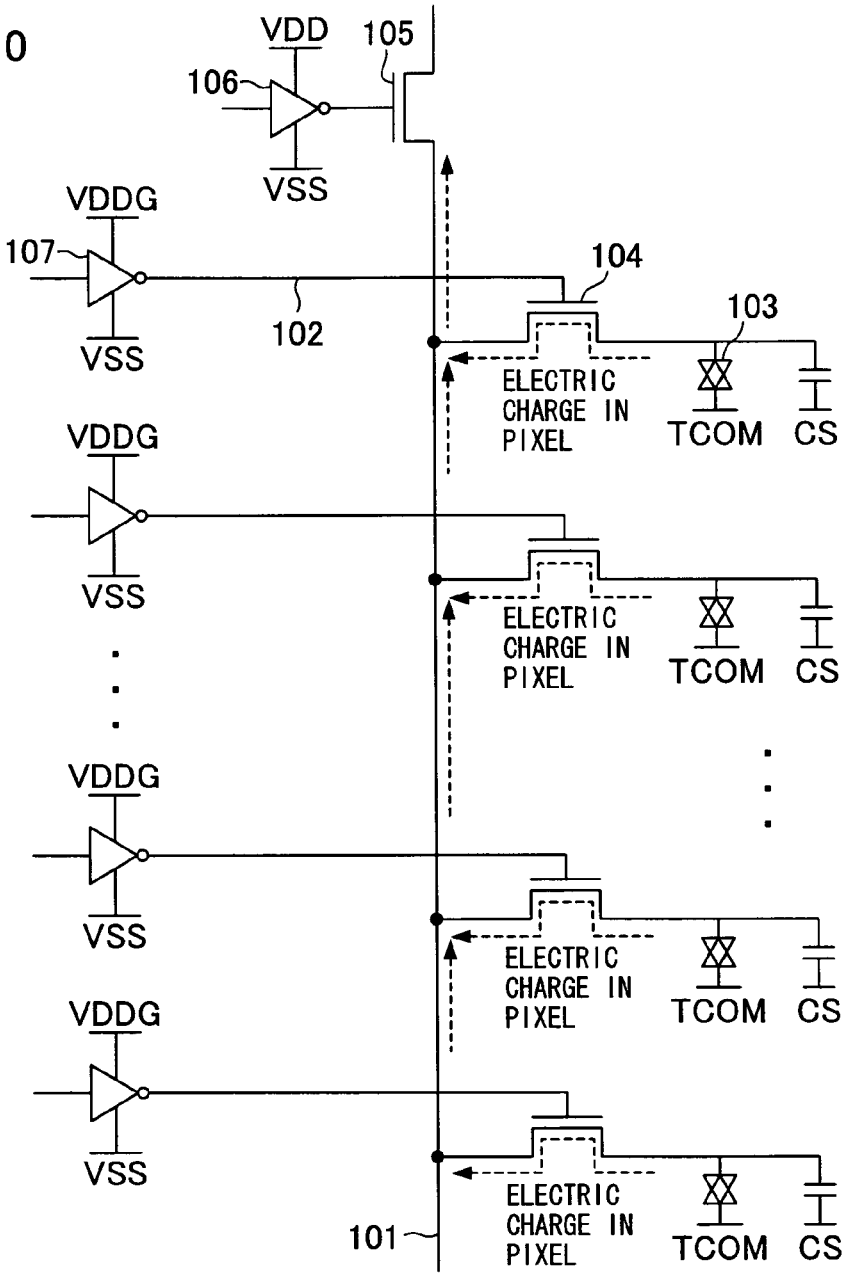
FIG. 10 is a circuit diagram illustrating a configuration of the conventional active matrix liquid crystal display device.
Figure 11:
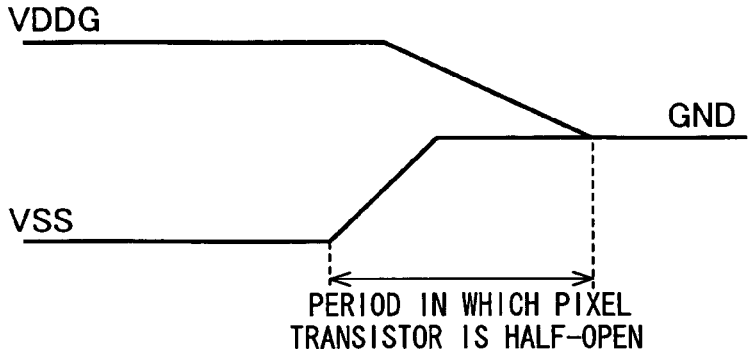
FIG. 11 is a waveform chart illustrating a profile of power supply voltages at the power-off of the active matrix liquid crystal display device illustrated in FIG. 10.
Figure 12:
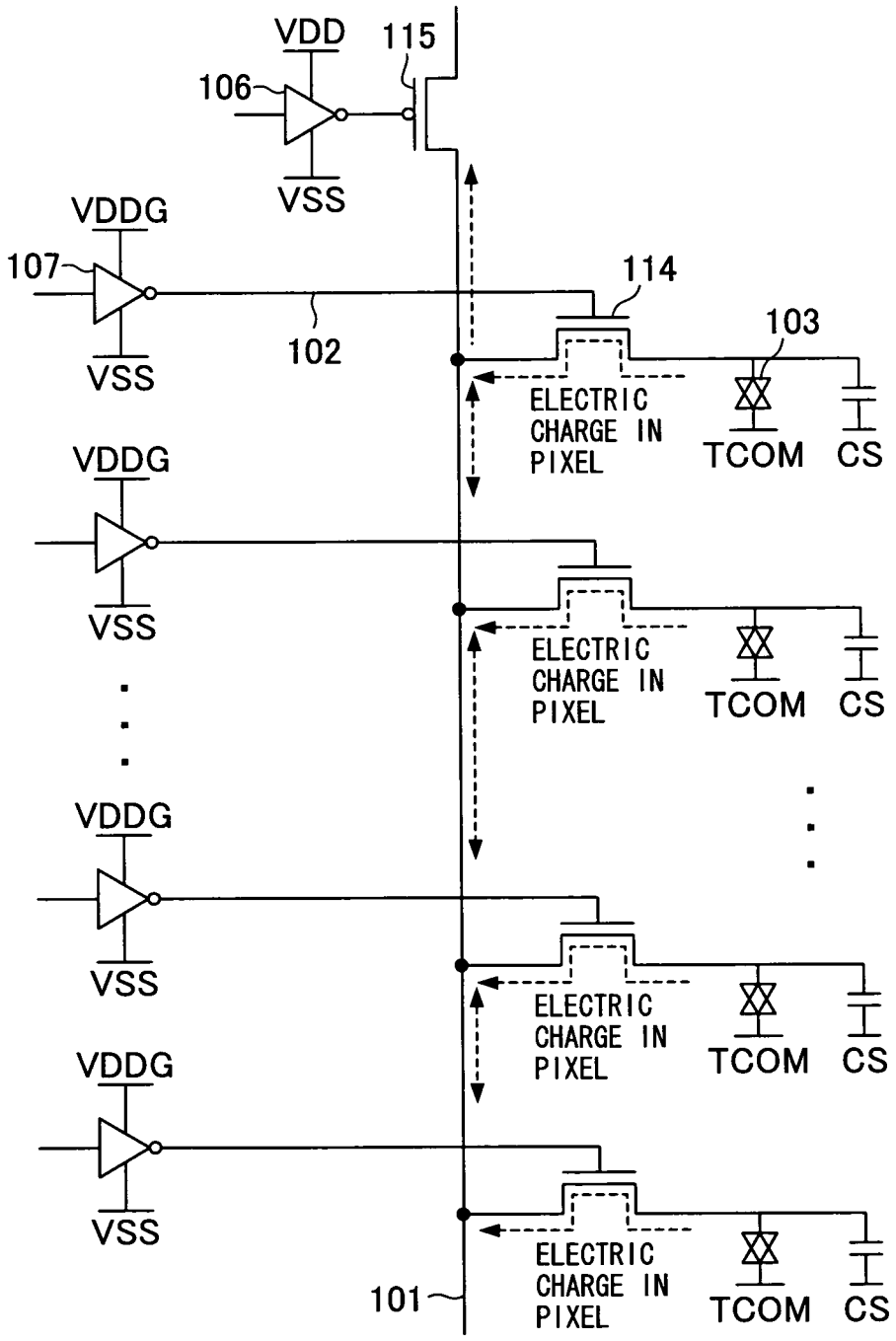
FIG. 12 is a circuit diagram illustrating a configuration of the conventional active matrix liquid crystal display device.

FIGS. 8 and 9 illustrate cases where the voltage VSS converges on the GND level after the voltage VDDG does.

In the case illustrated in FIG. 8, the voltage VSS becomes higher than the GND level, and then converges on the GND level. This case is more effective than the case illustrated in FIG. 2, in that the pixel transistor and the electric charge escaping transistor opens wider.

In the case illustrated in FIG. 9, the voltage VSS does not reach the GND level, but the voltage VSS approaches the GND level. This generates a sufficient time to let out electric charges with the pixel transistor and the electric charge escaping transistor half-open, thus allowing electric charges to be let out from the source bus line.

The above-described liquid crystal display device assumes that a turn-off voltage signal of the pixel transistor reaches the GND level before a turn-on voltage signal does at the power-off of the device. Besides, the above description assumes that the turn-off voltage signal and the turn-on voltage signal are supplied as power supply voltages from the outside of the liquid crystal display panel. The aforementioned control is performed outside the liquid crystal display panel. However, the present invention is also applicable to a liquid crystal display device having a power supply circuit inside a liquid crystal display panel if a power supply control circuit is provided inside the liquid crystal display panel. That is, when the liquid crystal display device is powered off, the power supply control circuit performs power supply control to make the turn-off voltage signal of the pixel transistor reach the GND-level voltage before the turn-on voltage signal of the pixel transistor does. The following will describe an embodiment in the case where a power supply circuit is provided inside a liquid crystal display panel.

Figure 19:
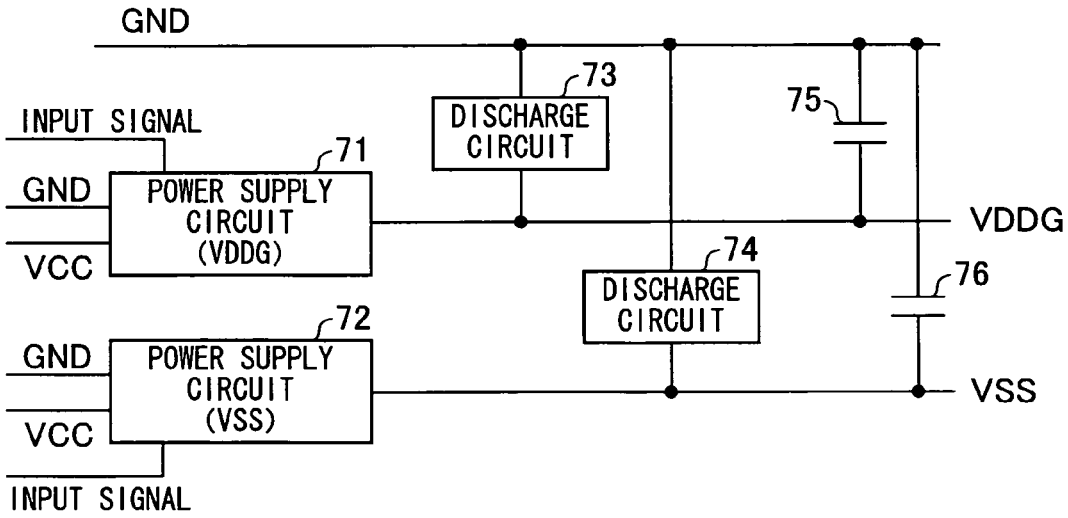
FIG. 19 is a circuit diagram illustrating a configuration for power supply control in a case where power supply circuits are embedded in a liquid crystal display panel.

FIG. 19 illustrates an example of the power supply control circuit in the case where power supply circuits are provided in a liquid crystal display panel. In the circuit illustrated in FIG. 19, only a power supply voltage VCC and a ground voltage GND are supplied to the liquid crystal display panel, and power supply circuits 71 and 72 in the liquid crystal display panel generates two types of power supply voltages, VDDG and VSS. That is, the power supply circuit 71 generates the power supply voltage VDDG, and the power supply circuit 72 generates the power supply voltage VSS.

Each of the power supply circuits 71 and 72 receives the power supply voltage VCC and the ground voltage GND, so that the power supply circuits 71 and 72 generate the power supply voltages VDDG and VSS, respectively, by using a charge pump, for example. The charge pump generates a desired voltage when a capacity is repeatedly charged and discharged. In FIG. 19, input signals supplied to the power supply circuits 71 and 72 are used for the control of the charging and discharging. In the present invention, the types of the power supply circuits 71 and 72 are not particularly limited, and a power supply circuit (e.g. resistive divider) other than the charge pump can be also used.

FIG. 19 illustrates the case where two types of power supply voltages are generated inside the liquid crystal display panel. However, three or more types of power supply voltages may be generated according to circumstances. For ease of explanation, only pixel transistor control voltages VDDG and VSS are given herein.

The power supply voltages VDDG and VSS generated by the power supply circuits 71 and 72 are supplied to, for example, the end buffer 17 and the buffer 32 in the circuit illustrated in FIG. 1. Then, when the voltage VSS is made reach the GND level before the voltage VDDG does, the aforementioned working occurs. This makes it possible to quickly let out electric charges from a pixel at the power-off of the device.

The power supply control circuit illustrated in FIG. 19 has discharge circuits 73 and 74 to drop the voltage VSS to the GND level before the voltage VDDG does. The discharge circuit 73 is provided between the power supply voltage VDDG outputted from the power supply circuit 71 and the ground voltage GND. The discharge circuit 74 is provided between the power supply voltage VSS outputted from the power supply circuit 72 and the ground voltage GND.

Figure 20:
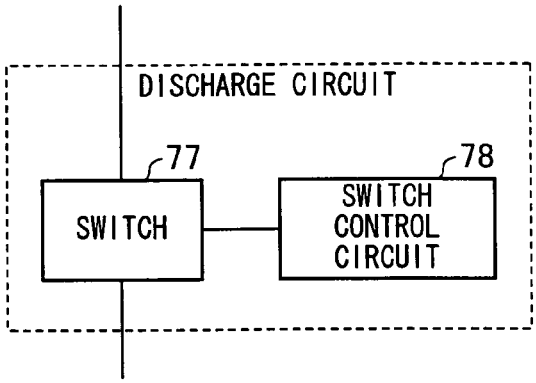
FIG. 20 is a block diagram illustrating a configuration of a discharge circuit in FIG. 19.

The discharge circuits 73 and 74 basically have the same structure, and each of the discharge circuits 73 and 74 includes a switch 77 and a switch control circuit 78 that controls the switch 77, as illustrated in FIG. 20. In the discharge circuits 73 and 74, the switch 77 is opened at the power-off of the liquid crystal display device, and closed at the power-on of the liquid crystal display device. That is, in the discharge circuits 73 and 74, the switch 77 is turned on at the power-off of the liquid crystal display device so that electric charges are let out from the discharge circuits 73 and 74 to the GND.

In the discharge circuits 73 and 74, a voltage of each signal reaches the GND level when the power supply voltage VCC drops. Therefore, if the switch 77 is a P-channel transistor, the switch 77 opens when the gate voltage is at the GND level. This ensures the switch 77 to be opened at the power-off of the liquid crystal display device.

On the other hand, at the power-on of the liquid crystal display device, the switch 77 needs a High signal (turn-off voltage of P-channel transistor). At the power-on of the device, the switch 77 needs to be reliably closed. According to circumstances, a signal for controlling the switch 77 needs to be shifted from the input signal level to another level. The switch control circuit 78 illustrated in FIG. 20 is provided to supply an input signal for reliably closing the switch 77 at the power-on of the device.

The above description assumes that the switch 77 is a P-channel transistor. However, the present invention is not limited to this. The switch 77 can be either P-channel transistor or N-channel transistor.

If the discharge circuits 73 and 74 are differentiated from each other in the ability of letting out electric charges, the power supply control as illustrated in FIG. 2 becomes possible. More specifically, if the discharge circuit 74 has a higher level of the ability of letting out electric charges than the discharge circuit 73, it is possible to drop the voltage VSS to the GND level before the VDDG voltage reaches the GND level.

One of the methods of differentiating the discharge circuits 73 and 74 in the ability of letting out electric charges is to change the abilities of the switches 77 in the discharge circuits 73 and 74. That is, the switch 77 is made up of a transistor in the liquid crystal display panel. Therefore, the transistors with different sizes can make the switches 77 different in their ability.

Figure 21:
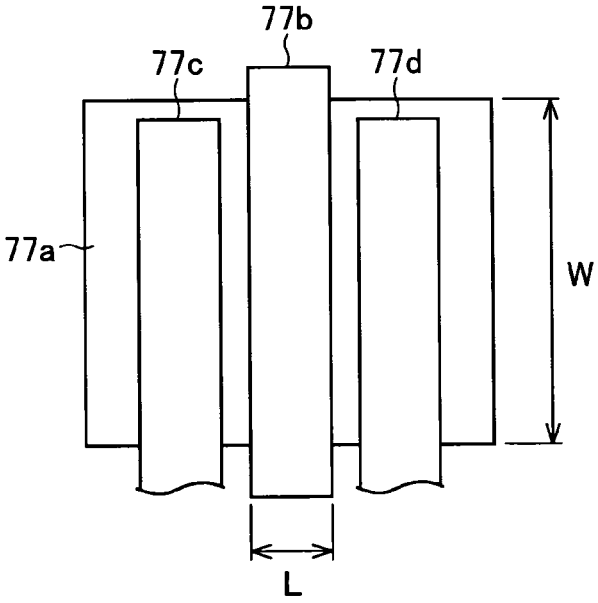
FIG. 21 is a plan view of a transistor constituting a switch in the discharge circuit.
Figure 22:
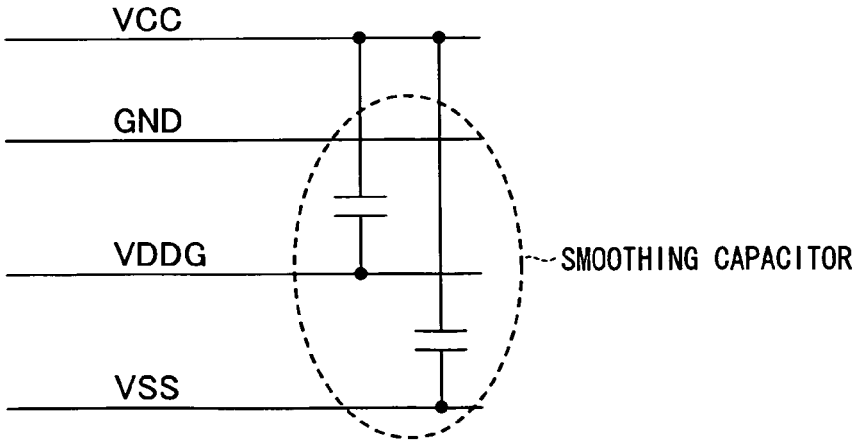
FIG. 22 is a diagram illustrating a variation of connections of a smoothing capacitor in FIG. 19.

FIG. 21 is a plan view of a transistor which makes up the switch 77. This transistor is such that a source electrode 77*b*, a gate electrode 77*c*, and a drain electrode 77*d* are disposed on a semiconductor layer 77*a* that includes a channel region. W indicates channel width, and L indicates channel length.

The larger the channel width W, the higher the level of the ability of the transistor. The smaller the channel length L, the lower the level of the ability of the transistor. In other words, the channel width W of the transistor which makes up the switch of the discharge circuit 74 is made larger than the channel width W of the transistor which makes up the switch of the discharge circuit 73. Alternatively, the channel length L of the transistor which makes up the switch of the discharge circuit 74 is made smaller than the channel length L of the transistor which makes up the switch of the discharge circuit 73.

Apart from the method of differentiating the abilities of the transistors which make up the switches 77, various kinds of methods by which the voltage VSS is dropped to the GND level before the VDDG voltage reaches the GND level are available.

For example, by changing a material for lines connected to the switches of the discharge circuits, it is possible to drop the voltage VSS to the GND level before the voltage VDDG reaches the GND level. That is, by using a high-resistance line as a switch line of the discharge circuit 73 and a low-resistance line as a switch line of the discharge circuit 74, it is possible to change the level of the ease of letting out electric charges. This makes it possible to perform the power supply control as illustrated in FIG. 2.

As a still another method, there is a method of connecting the power supply line VDDG inside the liquid crystal display panel to capacitance and load higher than those of the power supply line VSS. This slows down a speed at which electric charges are let out. This also makes it possible to perform the power supply control as illustrated in FIG. 2.

Further, the power supply control circuit illustrated in FIG. 19 includes smoothing capacitors 75 and 76 so that stable voltages can be supplied as the power supply voltages VDDG and VSS outputted from the power supply circuits 71 and 72. The smoothing capacitors 75 and 76 are provided to connect the power supply circuits 71 and 72 to a stable power source. In FIG. 19, the smoothing capacitor 75 is connected between the power supply circuit 71 and the GND, and the smoothing capacitor 76 is connected between the power supply circuit 72 and the GND.

The smoothing capacitors 75 and 76 are not necessarily provided inside the liquid crystal display panel. The smoothing capacitors 75 and 76 can be provided outside the liquid crystal display panel. A considerable area is required for the formation of capacitances of the smoothing capacitors 75 and 76 inside the liquid crystal display panel. Considering this, provision of the smoothing capacitors 75 and 76 outside the liquid crystal display panel is advantageous in downsizing the panel.

Capacitors included in the power supply circuits 71 and 72 (in the case where the power supply circuits 71 and 72 are realized by charge pumps) may be provided inside the liquid crystal display panel or outside the liquid crystal display panel. That is, in the case where the capacitors included in the power supply circuits 71 and 72 are provided outside the liquid crystal display panel, only circuits for controlling charging and discharging of the charge pumps are included in the liquid crystal display panel.

The stable power source to which the smoothing capacitors 75 and 76 is not necessarily the GND. The stable power source may be other stable power source (e.g. VCC) (see FIG. 22).

Thus, in the arrangement in which the smoothing capacitors 75 and 76 are provided, the discharge circuit 74 also lets out electric charges accumulated in the smoothing capacitors 75 and 76 at the power-off of the liquid crystal display device. For this reason, the capacitance of the smoothing capacitor 75 connected between the VDDG and the GND is made higher than the capacitance of the smoothing capacitor 76 connected between the VDVSS and the GND, whereby a VDDG dropping speed is slowed down at the power-off of the device. This makes it possible to perform the power supply control as illustrated in FIG. 2.

In the circuit configuration illustrated in FIG. 19, the discharge circuit 73 is connected between the VDDG line and the GND line, the discharge circuit 74 is connected between the VSS line and the GND line. However, this is not the only possibility. For example, as illustrated in FIG. 23, the discharge circuit 79 can be connected between the VDDG line and the GND line, and the discharge circuit 80 can be connected between the VSS line and the VDDG line.

Figure 23:
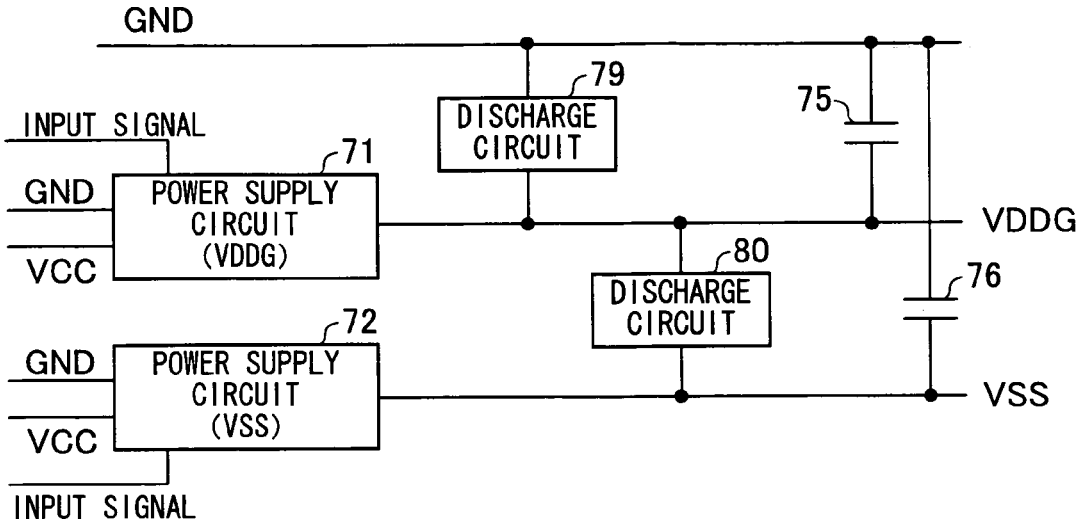
FIG. 23 is a circuit diagram illustrating a variation of a configuration for power supply control in a case where power supply circuits are embedded in a liquid crystal display panel.
Figure 24:
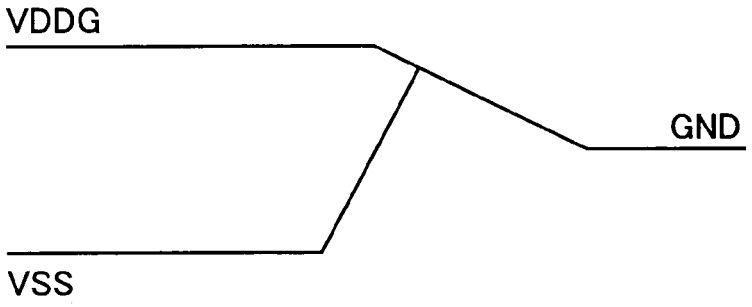
FIG. 24 is a waveform chart illustrating behaviors of VDDG and VSS signals under power supply control in the circuit illustrated in FIG. 23.

If the discharge circuits are connected as illustrated in FIG. 23, behaviors of VDDG and VSS at the power-off of the device can be controlled as illustrated in FIG. 24. In order to perform power supply control as illustrated in FIG. 24, capacitance of the smoothing capacitor 75 between VDDG and GND is made higher than capacitance of the smoothing capacitor 76 between VSS and GND, or capacitance and load connected to the power supply line VDDG in the liquid crystal display panel is made higher than those connected to the power supply line VSS.

Under the power supply control as illustrated in FIG. 24, VSS is exceeded GND by the discharge circuit 80 and pulled by VDDG at the power-off of the device. Since VSS come close to ON voltage, not to GND, the power supply control is close to the one illustrated in FIG. 8, not to the one illustrated in FIG. 2. This enables effective control to let out electric charges in the pixel electrode.

Figure 13:
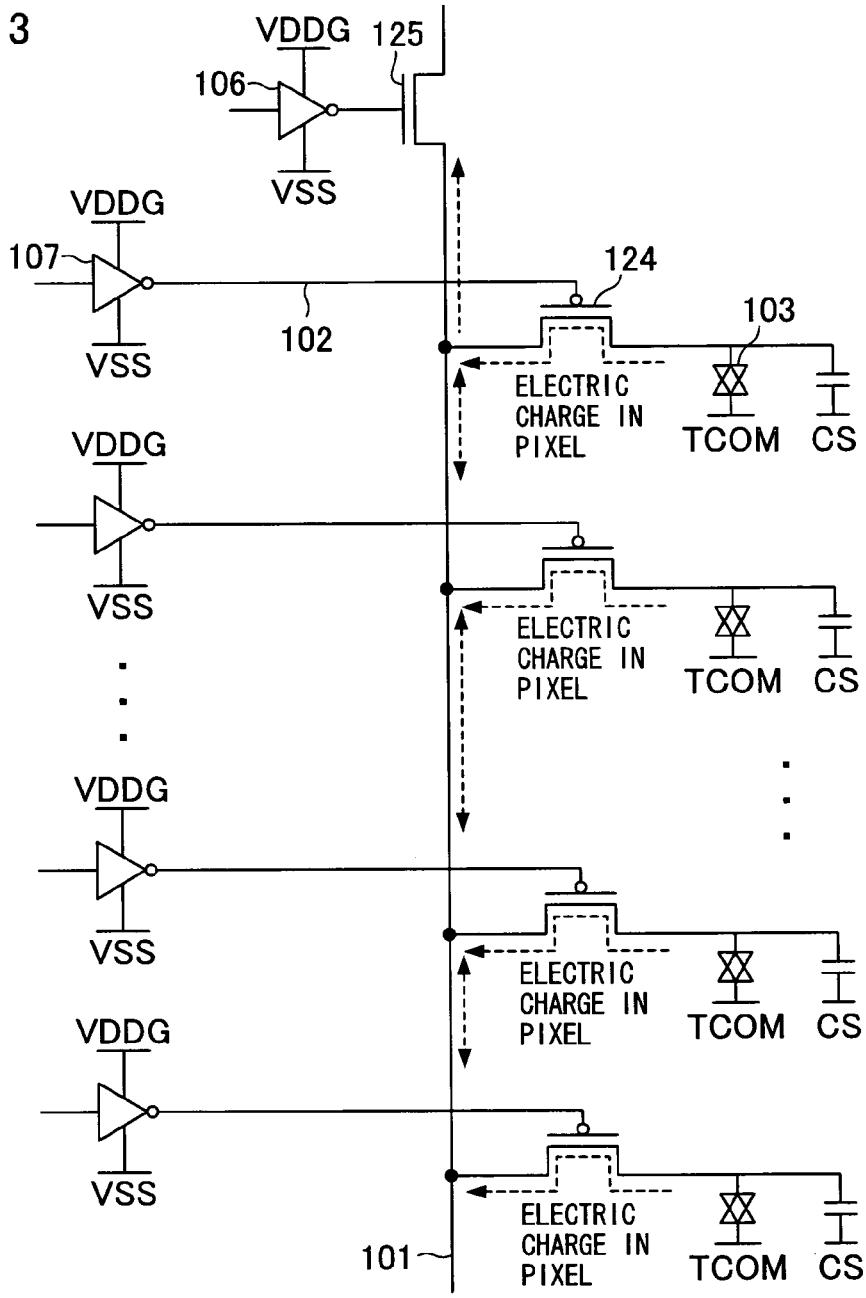
FIG. 13 is a circuit diagram illustrating a configuration of the conventional active matrix liquid crystal display device.
Figure 14:
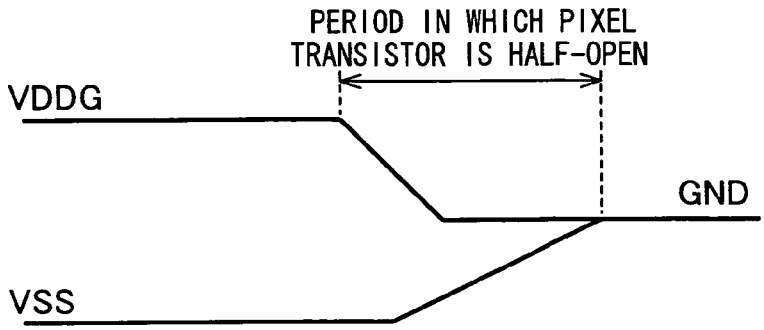
FIG. 14 is a waveform chart illustrating a profile of power supply voltages at the power-off of the active matrix liquid crystal display device illustrated in FIG. 13.
Figure 15:
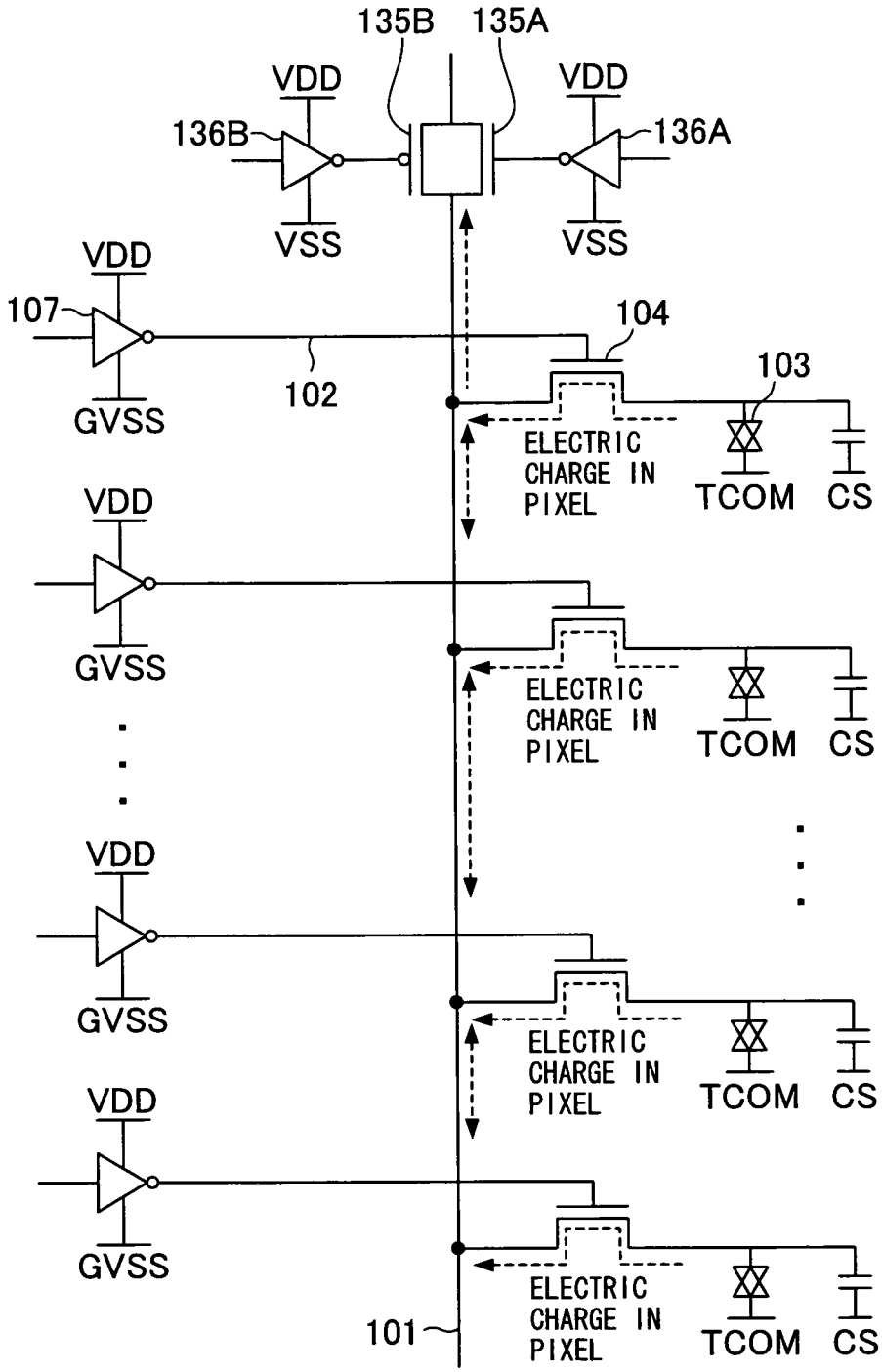
FIG. 15 is a circuit diagram illustrating a configuration of the conventional active matrix liquid crystal display device.
Figure 16:
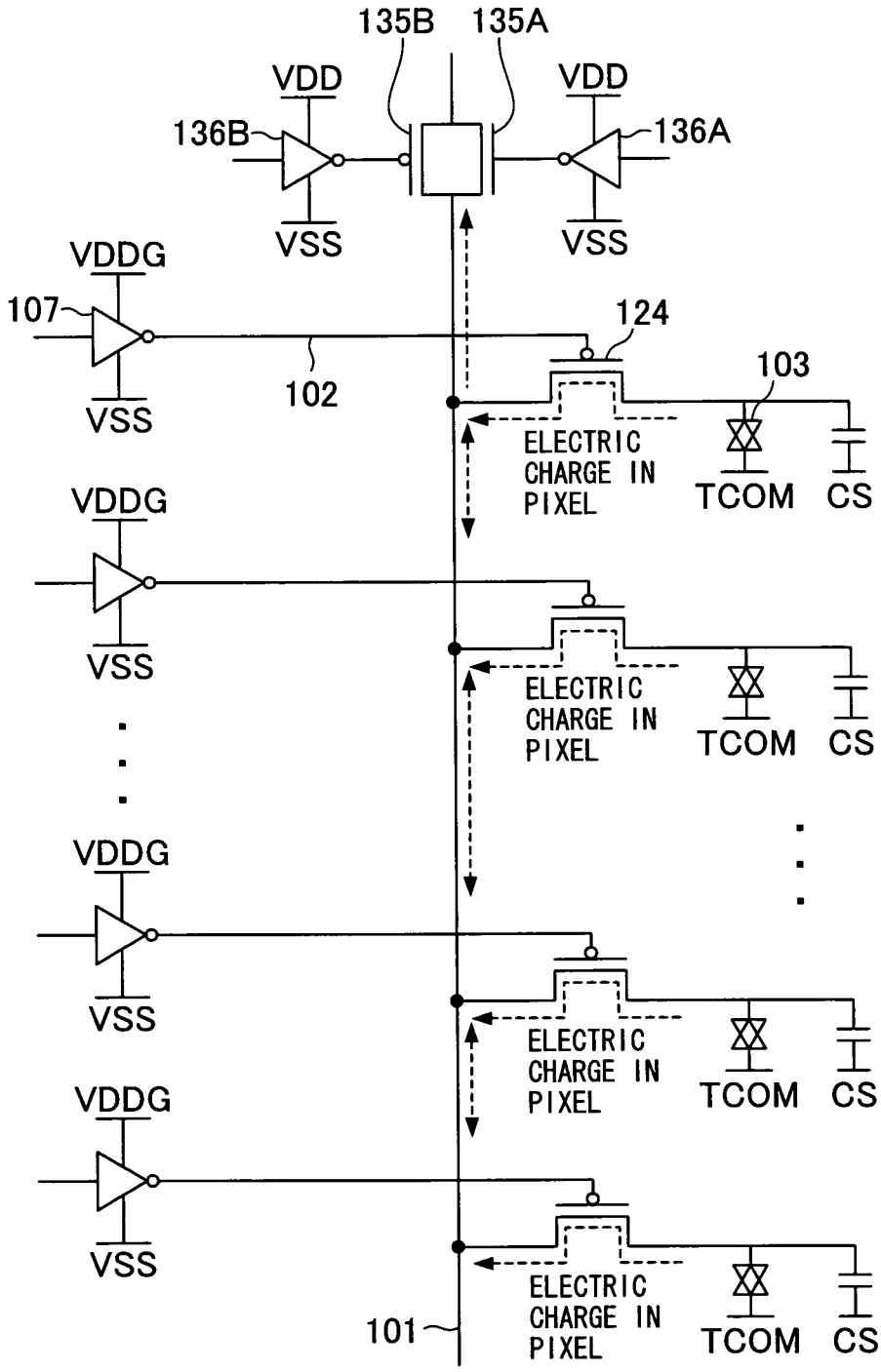
FIG. 16 is a circuit diagram illustrating a configuration of the conventional active matrix liquid crystal display device.
Figure 17:
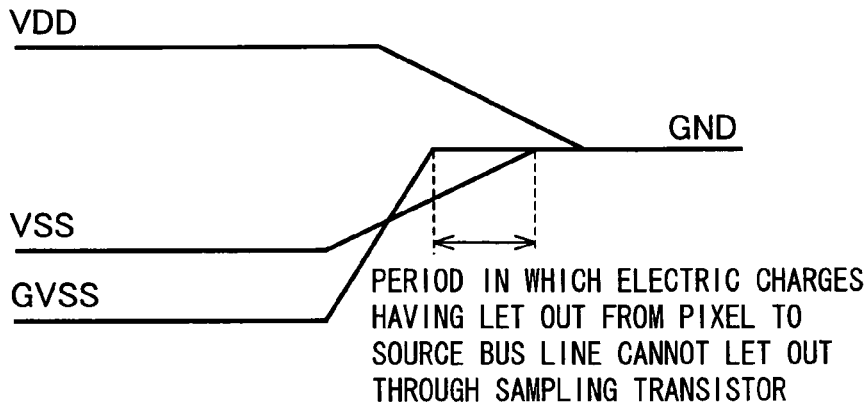
FIG. 17 is a waveform chart illustrating a profile of power supply voltages at the power-off of the active matrix liquid crystal display device illustrated in FIG. 15.
Figure 18:
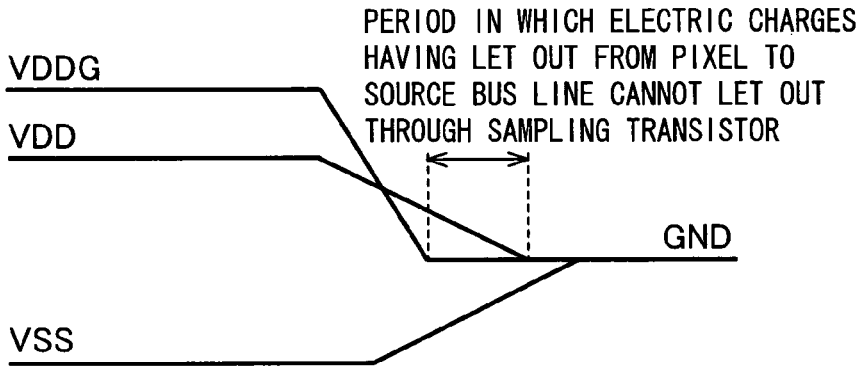
FIG. 18 is a waveform chart illustrating a profile of power supply voltages at the power-off of the active matrix liquid crystal display device illustrated in FIG. 16.

The arrangements of the power supply control circuits illustrated in FIGS. 19 and 23 are applicable to the configuration illustrated in FIG. 1. However, as a matter of course, the present invention is not limited to this. That is, the arrangements of the power supply control circuits illustrated in FIGS. 19 and 23 are similarly applicable to power supply controls in a case where the pixel transistor is a P-channel transistor and the sampling transistor is a N-channel transistor as illustrated in FIG. 13 and in a case where the sampling transistor is made up of P-channel transistor and N-channel transistor as illustrated in FIGS. 15 and 16.

As described above, an active matrix liquid crystal display device according to the present invention includes: a plurality of source bus lines; a plurality of gate bus lines; and pixels each provided at an intersection of the source bus line and the gate bus line and each connected to the gate bus line and the source bus line via a pixel transistor, and the active matrix liquid crystal display device further includes: an electric charge escaping transistor, provided on each of the source bus lines, having the same polarity as the pixel transistor and having a gate to which a turn-off voltage signal of the pixel transistor is supplied.

According to the above arrangement, the electric charge escaping transistor having the same polarity as the pixel transistor and having a gate to which a turn-off voltage signal of the pixel transistor is supplied is provided on each of the source lines. Even when the electric charges having let out from the pixel to the source bus line cannot let out through the sampling transistor, the above arrangement makes it possible to let the electric charges escape through the electric charge escaping transistor.

Besides, no special control signal is needed to make the pixel transistor and the electric charge escaping transistor half-open. Thus, it is possible to let out electric charges of the pixel with a simple configuration of the device.

Further, the active matrix liquid crystal display device is such that when the active matrix liquid crystal display device is powered off, the turn-off voltage signal of the pixel transistor is caused to reach a GND-level voltage before a turn-on voltage signal of the pixel transistor reaches the GND-level voltage.

According to the above arrangement, when the active matrix liquid crystal display device is powered off, the turn-off voltage signal of the pixel transistor is caused to reach a GND-level voltage before a turn-on voltage signal of the pixel transistor reaches the GND-level voltage.

When the turn-off voltage signal of the pixel transistor is caused to reach the GND-level voltage, the pixel transistor becomes half-open (the pixel transistor is not completely turned on, but has a certain degree of electrical continuity). The electric charge escaping transistor also becomes half-open. This allows the electric charges accumulated in each of the pixels to be let out to the outside via the pixel transistor and the electric charge escaping transistor. Thus, it is possible to let out electric charges of the pixel at the power-off of the device.

Another active matrix liquid crystal display device according to the present invention includes: a plurality of source bus lines; a plurality of gate bus lines; and pixels each provided at an intersection of the source bus line and the gate bus line and each connected to the gate bus line and the source bus line via a pixel transistor, and the active matrix liquid crystal display device further includes: an electric charge escaping transistor, provided on each of the source bus lines, having the same polarity as the pixel transistor; and voltage control means generating a gate control voltage from the turn-on voltage signal and the turn-off voltage signal of the pixel transistor and supplying the generated gate control voltage to the gate of the electric charge escaping transistor, wherein the gate control voltage generated by the voltage control means is a voltage for turning off the electric charge escaping transistor during an operation of the active matrix liquid crystal display device, and when the active matrix liquid crystal display device is powered off, the turn-off voltage signal of the pixel transistor is caused to reach a GND-level voltage before a turn-on voltage signal of the pixel transistor reaches the GND-level voltage, so that the gate control voltage changes to a voltage for turning on the electric charge escaping transistor.

According to the above arrangement, the electric charge escaping transistor having the same polarity as the pixel transistor is provided on each of the source lines. The gate control voltage generated by the voltage control means is supplied to the gate of the electric charge escaping transistor. Then, when the active matrix liquid crystal display device is powered off, the turn-off voltage signal of the pixel transistor is caused to reach the GND-level voltage before the turn-on voltage signal of the pixel transistor reaches the GND-level voltage.

When the turn-off voltage signal of the pixel transistor is caused to reach the GND-level voltage, the pixel transistor becomes half-open. In the electric charge escaping transistor, the gate control voltage changes to a voltage for turning on the electric charge escaping transistor. This allows the electric charges accumulated in each of the pixels to be escaped to the outside via the pixel transistor and the electric charge escaping transistor. Thus, it is possible to let out electric charges of the pixel at the power-off of the device. Especially, since the electric charge escaping transistor is not half-open but completely turned on, it is possible to reliably let electric charges escape from the source bus line.

Besides, no special control signal is needed to make the pixel transistor half-open and make the electric charge escaping transistor turn on. Thus, it is possible to let out electric charges of the pixel with a simple configuration of the device.

The active matrix liquid crystal display device is preferably arranged such that a first buffer which controls the electric charge escaping transistor is connected to the gate of the electric charge escaping transistor, a second buffer which controls the pixel transistor is connected to the gate bus line, and the first buffer has the same size and power system as the second buffer.

According to the above arrangement, when the turn-on voltage signal and the turn-off voltage signal cannot be controlled due to control system trouble or the like, the outputs of the first and second buffers become close to a midpoint voltage between the turn-on voltage signal and the turn-off voltage signal (normally becomes close to the GND voltage). Thus, even when control system trouble or the like occurs, the pixel transistor and the electric charge escaping transistor show the same behaviors. That is, making the pixel transistor half-open causes the electric charge escaping transistor to reliably become half-open, thus allowing electric charges of the pixel to escape.

Further, the active matrix liquid crystal display device is preferably such that each of the source bus lines is connected to a common electrode via the electric charge escaping transistor.

According to the above arrangement, electric charges that are let out from the pixel is transferred to the common electrode. This makes it possible to reliably eliminate the difference in voltage applied to liquid crystal of the pixel.

Further, the active matrix liquid crystal display device can be arranged such that a power supply control circuit is embedded in a liquid crystal display panel, and causes the turn-off voltage signal of the pixel transistor to reach the GND-level voltage before the turn-on voltage signal of the pixel transistor reaches the GND-level voltage, when the active matrix liquid crystal display device is powered off.

According to the above arrangement, the power supply control circuit can perform the foregoing power supply control even in a case where the turn-off voltage signal and the turn-on voltage signal are generated inside the liquid crystal display panel, instead of being supplied as power supply voltages from the outside of the liquid crystal display panel. This makes it possible to let out electric charges with a simple configuration of the device without the need for a special control signal.

Further, the active matrix liquid crystal display device can be arranged such that the power supply control circuit includes: a first power supply circuit which generates the turn-on voltage signal of the pixel transistor; a second power supply circuit which generates the turn-off voltage signal of the pixel transistor; a first discharge circuit which lets out electric charges of the first power supply circuit when the active matrix liquid crystal display device is powered off; and a second discharge circuit which lets out electric charges of the second power supply circuit when the active matrix liquid crystal display device is powered off, wherein the first discharge circuit and the second discharge circuit let out electric charges of the first power supply circuit and the second power supply circuit, respectively, under on/off control of switches that constitute transistors, and difference in size between the transistors of the first and second discharge circuits causes the turn-off voltage signal of the pixel transistor to reach the GND-level voltage before the turn-on voltage signal of the pixel transistor reaches the GND-level voltage.

According to the above arrangement, difference in size between the transistors of the first and second discharge circuits (for example, making a channel W of the transistor constituting the switch of the second discharge circuit greater in width than a channel of the transistor constituting the switch of the first discharge circuit or making a channel of the transistor constituting the switch of the second discharge circuit greater in length than a channel of the transistor constituting the switch of the first discharge circuit) makes it possible to let out electric charges of the second power supply circuit earlier than electric charges of the first power supply circuit. In other words, it is possible to make the turn-off voltage signal of the pixel transistor reach the GND-level voltage before the turn-on voltage signal of the pixel transistor reaches the GND-level voltage.

Further, the active matrix liquid crystal display device can be arranged such that the power supply control circuit includes: a first power supply circuit which generates the turn-on voltage signal of the pixel transistor; a second power supply circuit which generates the turn-off voltage signal of the pixel transistor; a first discharge circuit which lets out electric charges of the first power supply circuit when the active matrix liquid crystal display device is powered off; and a second discharge circuit which lets out electric charges of the second power supply circuit when the active matrix liquid crystal display device is powered off, wherein difference in load between lines connected to the first and second discharge circuits causes the turn-off voltage signal of the pixel transistor to reach the GND-level voltage before the turn-on voltage signal of the pixel transistor reaches the GND-level voltage.

According to the above arrangement, the difference in load between lines connected to the first and second discharge circuits (for example, using a high-resistance line as a switch line of the first discharge circuit and a low-resistance line as a switch line of the second discharge circuit) makes it possible to let out electric charges of the second power supply circuit earlier than electric charges of the first power supply circuit. In other words, it is possible to make the turn-off voltage signal of the pixel transistor reach the GND-level voltage before the turn-on voltage signal of the pixel transistor reaches the GND-level voltage.

Further, the active matrix liquid crystal display device can be arranged such that the power supply control circuit includes: a first power supply circuit which generates the turn-on voltage signal of the pixel transistor; a second power supply circuit which generates the turn-off voltage signal of the pixel transistor; a first discharge circuit which lets out electric charges of the first power supply circuit when the active matrix liquid crystal display device is powered off; and a second discharge circuit which lets out electric charges of the second power supply circuit when the active matrix liquid crystal display device is powered off, wherein difference between capacitance and load, inside the liquid crystal display panel, connected to the first power supply circuit and those connected to the second power supply circuit causes the turn-off voltage signal of the pixel transistor to reach the GND-level voltage before the turn-on voltage signal of the pixel transistor reaches the GND-level voltage.

According to the above arrangement, the difference between capacitance and load, inside the liquid crystal display panel, connected to the first power supply circuit and those connected to the second power supply circuit (for example, connecting a line which is connected to the first power supply circuit and outputs the turn-on voltage signal to capacitance and load higher than a line which is connected to the second power supply circuit and outputs the turn-off voltage signal) makes it possible to let out electric charges of the second power supply circuit earlier than electric charges of the first power supply circuit. In other words, it is possible to make the turn-off voltage signal of the pixel transistor reach the GND-level voltage before the turn-on voltage signal of the pixel transistor reaches the GND-level voltage.

The present invention is not limited to the description of the embodiments above, but may be altered by a skilled person within the scope of the claims. An embodiment based on a proper combination of technical means disclosed in different embodiments is encompassed in the technical scope of the present invention.

The invention claimed is:

1. An active matrix liquid crystal display device comprising:

a liquid crystal display panel;

a plurality of source bus lines provided on the liquid crystal display panel;

a plurality of gate bus lines provided on the liquid crystal display panel;

pixels each provided at an intersection of the source bus line and the gate bus line and each connected to the gate bus line and the source bus line via a pixel transistor;

a first terminal provided on the liquid crystal display panel and configured to output a turn-on voltage of the pixel transistor;

a second terminal provided on the liquid crystal display panel and configured to output a turn-off voltage of the pixel transistor; and an electric charge escaping transistor, provided on each of the source bus lines, having the same polarity as the pixel transistor and having a gate terminal configured to receive only the turn-off voltage while the second terminal is outputting the turn-off voltage.

2. The active matrix liquid crystal display device according to claim 1, wherein if the active matrix liquid crystal display device is powered off, the voltage outputted from the second terminal is caused to reach a ground (GND)-level voltage before the voltage outputted from the first terminal reaches the GND-level voltage.

3. The active matrix liquid crystal display device according to claim 2, further comprising:

a power supply control circuit configured to supply the turn-on voltage to the first terminal and supply the turn-off voltage to the second terminal, and cause the voltage outputted from the second terminal to reach the GND-level voltage before the voltage outputted from the first terminal reaches the GND-level voltage, if the active matrix liquid crystal device is powered off, wherein at least part of the power supply control circuit is embedded in the liquid crystal display panel.

4. The active matrix liquid crystal display device according to claim 3, wherein the power supply control circuit includes, a first power supply circuit configured to generate the turn-on voltage and supply the turn-on voltage to the first terminal;

a second power supply circuit configured to generate the turn-off voltage and supply the turn-off voltage to the second terminal;

a first discharge circuit which is embedded in the liquid crystal display panel and lets out electric charges of the first power supply circuit if the active matrix liquid crystal display device is powered off; and a second discharge circuit which is embedded in the liquid crystal display panel and lets out electric charges of the second power supply circuit if the active matrix liquid crystal display device is powered off, wherein the first discharge circuit and the second discharge circuit are configured to let out electric charges of the first power supply circuit and the second power supply circuit, respectively, under on/off control of switches that constitute transistors, and a difference in size between the transistors of the first and second discharge circuits causes the voltage outputted from the second terminal to reach the GND-level voltage before the voltage outputted from the first terminal reaches the GND-level voltage.

5. The active matrix liquid crystal display device according to claim 3, wherein the power supply control circuit includes, a first power supply circuit configured to generate the turn-on voltage and supply the turn-on voltage to the first terminal;

a second power supply circuit configured to generate the turn-off voltage and supply the turn-off voltage to the second terminal;

a first discharge circuit which is embedded in the liquid crystal display panel and lets out electric charges of the first power supply circuit if the active matrix liquid crystal display device is powered off; and a second discharge circuit which is embedded in the liquid crystal display panel and lets out electric charges of the second power supply circuit if the active matrix liquid crystal display device is powered off, wherein a difference in load between lines connected to the first and second discharge circuits causes the voltage outputted from the second terminal to reach the GND-level voltage before the voltage outputted from the first terminal reaches the GND-level voltage.

6. The active matrix liquid crystal display device according to claim 3, wherein the power supply control circuit includes, a first power supply circuit configured to generate the turn-on voltage and supply the turn-on voltage to the first terminal;

a second power supply circuit configured to generate the turn-off voltage and supply the turn-off voltage to the second terminal;

a first discharge circuit which is embedded in the liquid crystal display panel and lets out electric charges of the first power supply circuit if the active matrix liquid crystal display device is powered off; and a second discharge circuit which is embedded in the liquid crystal display panel and lets out electric charges of the second power supply circuit if the active matrix liquid crystal display device is powered off, wherein a difference between capacitance and load connected to the first power supply circuit and those connected to the second power supply circuit causes the voltage outputted from the second terminal to reach the GND-level voltage before the voltage outputted from the first terminal reaches the GND-level voltage.

7. The active matrix liquid crystal display device according to claim 3, wherein the power supply control circuit includes, a first power supply circuit configured to generate the turn-on voltage and supply the turn-on voltage to the first terminal;

a second power supply circuit configured to generate the turn-off voltage and supply the turn-off voltage to the second terminal;

a first discharge circuit which is embedded in the liquid crystal display panel and lets out electric charges of the first power supply circuit if the active matrix liquid crystal display device is powered off;

a second discharge circuit which is embedded in the liquid crystal display panel and lets out electric discharge of the second power supply circuit if the active matrix liquid crystal display device is powered off; and smoothing capacitors which are connected to an external entity outside the liquid crystal display panel and are configured to stabilize voltages supplied by the first power supply circuit and the second power supply circuit, wherein making capacitances of the smoothing capacitors different from each other causes the voltage outputted from the second terminal to reach the GND-level voltage before the voltage outputted from the first terminal reaches the GND-level voltage.

8. The active matrix liquid crystal display device according to claim 1, wherein a first buffer provided on the liquid crystal display panel and configured to control the electric charge escaping transistor is connected to the gate terminal of the electric charge escaping transistor, a second buffer provided on the liquid crystal display panel and configured to control the pixel transistor is connected to the gate bus line, and the first buffer has the same size and power system as the second buffer.

9. The active matrix liquid crystal display device according to claim 1, wherein each of the source bus lines is connected to a common electrode via the electric charge escaping transistor.

10. The active matrix liquid crystal display device according to claim 1, wherein the gate terminal of the electric charge escaping transistor is directly connected to the second terminal.

11. The active matrix liquid crystal display device according to claim 1, wherein the gate terminal of the electric charge escaping transistor is connected to an output terminal of a buffer circuit configured to output the turn-off voltage while the second terminal is outputting the turn-off voltage.

12. The active matrix liquid crystal display device according to claim 1, wherein both of the turn-on voltage and the turn-off voltage are supplied to the first terminal and the second terminal from outside the liquid crystal display panel, respectively.

13. An active matrix liquid crystal display device comprising:

a liquid crystal display panel;

a plurality of source bus lines provided on the liquid crystal display panel;

a plurality of gate bus lines provided on the liquid crystal display panel;

pixels each provided at an intersection of the source bus line and the gate bus line and each connected to the gate bus line and the source bus line via a pixel transistor;

a first terminal provided on the liquid crystal display panel and configured to output a turn-on voltage of the pixel transistor;

a second terminal provided on the liquid crystal display panel and configured to output a turn-off voltage of the pixel transistor;

an electric charge escaping transistor, provided on each of the source bus lines, having the same polarity as the pixel transistor; and a voltage controller configured to generate a gate control voltage from the turn-on voltage and the turn-off voltage for the pixel transistor and supply the generated gate control voltage to the gate of the electric charge escaping transistor, wherein the gate control voltage generated by the voltage controller is a voltage for turning off the electric charge escaping transistor while the first terminal is outputting the turn-on voltage and the second terminal is outputting the turn-off voltage, and if the active matrix liquid crystal display device is powered off, the voltage outputted from the second terminal is caused to reach a ground (GND)-level voltage before the voltage outputted from the first terminal reaches the GND-level voltage, such that the gate control voltage changes to a voltage for at least partially opening the electric charge escaping transistor.

14. The active matrix liquid crystal display device according to claim 13, wherein each of the source bus lines is connected to a common electrode via the electric charge escaping transistor.

15. The active matrix liquid crystal display device according to claim 13, further comprising:

a power supply control circuit is configured to supply the turn-on voltage to the first terminal and supply the turn-off voltage to the second terminal, and cause the voltage outputted from the second terminal to reach the GND-level voltage before the voltage outputted from the first terminal reaches the GND-level voltage, if the active matrix liquid crystal display device is powered off, wherein at least part of the power supply control circuit is embedded in a liquid crystal display panel.

16. A method of driving an active matrix liquid crystal display device comprising:

a liquid crystal display panel;

a plurality of source bus lines provided on the liquid crystal display panel;

a plurality of gate bus lines provided on the liquid crystal display panel;

pixels each provided at an intersection of the source bus line and the gate bus line and each connected to the gate bus line and the source bus line via a pixel transistor;

a first terminal provided on the liquid crystal display panel and configured to output a turn-on voltage of the pixel transistor;

a second terminal provided on the liquid crystal display panel and configured to output a turn-off voltage of the pixel transistor; and an electric charge escaping transistor, provided on each of the source bus lines, having the same polarity as the pixel transistor and having a gate terminal configured to receive only the turn-off voltage while the second terminal is outputting the turn-off voltage, wherein if the active matrix liquid crystal display device is powered off, the voltage outputted from the second terminal is caused to reach a ground (GND)-level voltage before the voltage outputted from the first terminal reaches the GND-level voltage, so that the pixel transistor and the electric charge escaping transistor become half-open, whereby electric charges accumulated in each of the pixels are let escape.

* * * * *